US005498815A

United States Patent [19]

Schaerfl, Jr. et al.

[11] Patent Number: 5,498,815

[45] Date of Patent: Mar. 12, 1996

[54] PREPARATION OF SYNTHETIC OILS FROM VINYLIDENE OLEFINS AND ALPHA-OLEFINS

[75] Inventors: Robert A. Schaerfl, Jr.; Ali M. Dadgar, both of Baton Rouge; Carroll W. Lanier, Baker, all of La.

[73] Assignee: Albemarle Corporation, Richmond, Va.

[21] Appl. No.: 806,303

[22] Filed: Dec. 13, 1991

[51] Int. Cl.[6] ..... C07C 2/08

[52] U.S. Cl. ..... 585/512; 585/513; 585/522; 585/525; 585/526; 585/329; 585/312; 585/313

[58] Field of Search ..... 585/512, 513, 585/522, 525, 526, 329, 312, 313

[56] References Cited

U.S. PATENT DOCUMENTS

| | | | |
|---|---|---|---|
| 2,695,327 | 11/1954 | Ziegler et al. | 260/683.15 |
| 3,576,898 | 4/1971 | Blake et al. | 260/676 |
| 3,749,560 | 7/1973 | Perilstein | 44/80 |
| 3,876,720 | 4/1975 | Heilman et al. | 260/677 R |
| 3,907,922 | 9/1975 | Heilman et al. | 260/683.15 B |
| 4,172,855 | 10/1979 | Shubkin et al. | 585/16 |
| 4,263,465 | 4/1981 | Sheng et al. | 585/329 |
| 4,451,684 | 5/1984 | Pasky | 585/329 |
| 4,469,912 | 9/1984 | Blewett et al. | 585/525 |
| 4,697,040 | 9/1987 | Williamson et al. | 585/666 |
| 4,973,788 | 11/1990 | Lin et al. | 585/511 |
| 5,095,172 | 3/1992 | Lanier et al. | 585/851 |

FOREIGN PATENT DOCUMENTS

| | | | |
|---|---|---|---|
| 377306 | 7/1990 | European Pat. Off. | C10G 69/12 |

*Primary Examiner*—Asok Pal

*Attorney, Agent, or Firm*—Philip M. Pippenger; David M. Bunnell

[57] ABSTRACT

A synthetic oil is made by a process comprising the steps of (a) reacting a vinylidene olefin in the presence of a catalyst to form an intermediate mixture which contains at least about 50 weight percent dimer of said vinylidene olefin, and (b) adding a vinyl olefin to said intermediate mixture and reacting said intermediate mixture and said vinyl olefin in the presence of a catalyst so as to form a product mixture which contains said dimer of said vinylidene olefin and a codimer of said added vinyl olefin with said vinylidene olefin.

6 Claims, No Drawings

PREPARATION OF SYNTHETIC OILS FROM VINYLIDENE OLEFINS AND ALPHA-OLEFINS

This invention relates generally to the preparation of synthetic oils from a combination of alkenes and more specifically to the preparation of synthetic oils by reacting a vinylidene olefin using a catalyst to form an intermediate mixture which contains at least about 50 weight percent dimer of said vinylidene olefin and then reacting the intermediate mixture with a vinyl olefin to form an oil which is mostly a mixture of said dimer and a co-dimer of the vinylidene olefin and the vinyl olefin.

In the specification, olefins are referred to as: "alpha-olefins" or "vinyl olefins" R—CH=$CH_2$, and "vinylidene olefins"

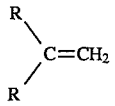

wherein R represents a hydrocarbon group.

Alpha-olefin oligomers (PAO's) derived from the catalyzed oligomerization of $C_6$ or higher alpha-olefin monomers and their use as functional fluids and synthetic lubricants are well known.

Alpha-olefins most useful in preparing synthetic base oils are mainly linear, terminal olefins containing about 8–12 carbon atoms such as 1-octene, 1-decene, 1-dodecene and the like including mixtures thereof. The most preferred alpha-olefin is 1-decene or an olefin mixture containing mainly, for example, at least 75 weight percent 1-decene.

The oligomer products are mixtures which include varying amounts of dimer, trimer, tetramer, pentamer and higher oligomers of the monomers, depending upon the particular alpha-olefin, catalyst and reaction conditions. The products are unsaturated and usually have viscosities ranging from about 2 to 100 cSt and especially 2 to 15 cSt at 100° C.

The product viscosity can be further adjusted by either removing or adding higher or lower oligomers to provide a composition having the desired viscosity for a particular application. Such oligomers are usually hydrogenated to improve their oxidation resistance and are known for their superior properties of long-life, low volatility, low pour points and high viscosity indexes which make them a premier basestock for state-of-the-art lubricants and hydraulic fluids.

Suitable catalysts for making alpha-olefin oligomers include Friedel-Crafts catalyst such as $BF_3$ with a promoter such as water or an alcohol. Alternative processes for producing synthetic oils include forming vinylidene dimers of vinyl-olefins using a Ziegler catalyst, for example, as described in U.S. Pat. Nos. 2,695,327 and 4,973,788 which dimer can be further dimerized to a tetramer using a Friedel-Crafts catalyst, as described for example in U.S. Pat. Nos. 3,576,898 and 3,876,720.

One problem associated with making oligomer oils from vinyl olefins is that the oligomer product mix usually must be fractionated into different portions to obtain oils of a given desired viscosity (e.g. 2, 4, 6 or 8 cSt at 100° C.). Another problem is lack of control over the chemistry, and isomerization of alpha olefins to internal olefins.

In commercial production it is difficult to obtain an oligomer product mix which, when fractionated, will produce the relative amounts of each viscosity product which correspond to market demand. Therefore, it is often necessary to produce an excess of one product in order to obtain the needed amount of the other.

Vinylidene olefins can be selectively dimerized and the process can be made more versatile in producing products of different viscosities as described in U.S. Pat. No. 4,172,855 where a vinylidene olefin dimer is reacted with a vinyl olefin to form a graft of the vinyl olefin onto the vinylidene olefin.

Although vinylidene olefins can be selectively dimerized in the absence of alpha-olefins to produce a product oil having a carbon number of twice that of the vinylidene olefin, complete conversion of the vinylidene olefins to dimer does not occur and the maximum conversion is about 75 to 95 percent. The reason for this limited conversion is not exactly known but may be due to concentration effects, a reversible equilibrium reaction and/or the isomerization of the vinylidene to a less reactive olefin.

A process has now been found which not only improves the conversion of vinylidene olefin to a useful synthetic oil product, but provides the versatility of allowing one to tailor the product viscosity, as in the case of U.S. Pat. No. 4,172,855, with improved selectivity. This allows product oils of a selected desired viscosity to be easily and reproducibly prepared.

In accordance with this invention there is provided a process for making a synthetic oil, said process comprising the steps of (a) reacting a vinylidene olefin in the presence of a catalyst to form an intermediate mixture which contains at least about 50 weight percent dimer of said vinylidene olefin, and (b) adding a vinyl olefin to said intermediate mixture and reacting said intermediate mixture and said vinyl olefin in the presence of a catalyst so as to form a product mixture which contains said dimer of said vinylidene olefin and a co-dimer of said added vinyl olefin with said vinylidene olefin.

Suitable vinylidene olefins for use in the process can be prepared using known methods, such as by dimerizing vinyl olefins containing from 4 to about 30 carbon atoms, preferably at least 6, and most preferably at least 8 to about 20 carbon atoms, including mixtures thereof. Such a process, which uses a trialkylaluminum catalyst, is described, for example, in U.S. Pat. No. 4,973,788, whose teachings are incorporated herein by reference. Other suitable processes and catalysts are disclosed in U.S. Pat. No. 4,172,855.

Suitable vinyl olefins for use in the process contain from 4 to about 30 carbon atoms, and, preferably, about 6 to 24 carbon atoms, including mixtures thereof. Non-limiting examples include 1-butene, 1-pentene, 1-hexene, 1-heptene, 1-octene, 1-decene, 1-dodecene, 1-tetradecene, 1-hexadecene, 1-octadecene, 1-eicosene and the like. Pure vinyl olefins or a mixed feed of vinyl olefins and vinylidene and/or internal olefins can be used. Usually, the feed contains at least about 85 weight percent vinyl olefin. A typical $C_{14}$ feed obtained from ethylene chain growth contains about 10 weight percent vinylidene olefins, which react, and the other 90 percent consists of alpha and internal olefins. Some of the vinyl and internal olefins react. The unreacted $C_{14}$s contain only vinyl and internal olefins resulting in a $C_{14}$ portion containing a reduced amount of branched isomers.

Both the dimerization and co-dimerization steps can use any suitable oligomerization catalyst known in the art and especially Friedel-Crafts type catalysts such as acid halides (Lewis Acid) or proton acid (Bronsted Acid) catalysts. Examples of such dimerization catalysts include but are not limited to $BF_3$, $BCl_3$, $BBr_3$, sulfuric acid, anhydrous HF, phosphoric acid, polyphosphoric acid, perchloric acid, fluorosulfuric acid, aromatic sulfuric acids, and the like. The catalysts can be used in combination and with promoters such as water, alcohols, hydrogen halide, alkyl halides and the like. A preferred catalyst for the process is the $BF_3$- promoter catalyst system. Suitable promoters are polar compounds and preferably alcohols containing about 1 to 8 carbon atoms such as methanol, ethanol, isopropanol, n-propanol, n-butanol, isobutanol, n-hexanol, n-octanol and the like. Other suitable promoters include, for example, water, phosphoric acid, fatty acids (e.g. valeric acid) aldehydes, acid anhydrides, ketones, organic esters, ethers, polyhydric alcohols, phenols, ether alcohols and the like. A preferred promoter is methanol. The ethers, esters, acid anhydrides, ketones and aldehydes provide good promotion properties when combined with other promoters which have an active proton e.g. water or alcohols.

Amounts of promoter are used which are effective to provide good conversions in a reasonable time. Generally amounts of 0.01 weight percent or greater, based on the total amounts of olefin reactants, can be used. Amounts greater than 1.0 weight percent can be used but are not usually necessary. Preferred amounts range from about 0.025 to 0.5 weight percent of the total amount of olefin reactants. Amounts of $BF_3$ are used to provide molar ratios of $BF_3$ to promoter of from about 0.1 to 10:1 and preferably greater than about 1:1. For example, amounts of $BF_3$ of from about 0.1 to 3.0 weight percent of the total amount of olefin reactants.

The amount of catalyst used can be kept to a minimum by bubbling $BF_3$ into an agitated mixture of the olefin reactant only until an "observable" condition is satisfied, i.e. a 2°–4° C. increase in temperature. Because the vinylidene olefins are more reactive than vinyl olefin, less $BF_3$ catalyst is needed compared to the vinyl olefin oligomerization process normally used to produce PAO's. The same catalyst can be used for both steps of the reaction, but a different catalyst can be used for the co-dimerization step, if desired. The process can be conveniently carried out either as a single pot, two-step batch process or as a continuous process in which the vinyl olefin is added to a second reaction zone downstream from the initial dimerization reaction. The continuous process can employ, for example, a single tubular reactor or two or more reactors arranged in series.

The process of the invention provides for higher conversion of the starting vinylidene olefin to useful product oils by converting the undimerized vinylidene olefin to codimer oils. The process also permits control of the factors that determine the properties the PAO product. By varying the choice of initial vinylidene olefin and the post added alpha-olefin, customer-specific PAO products can be produced. For example, the viscosity of such a product can be varied by changing the amount and type of alpha-olefin used for reaction in the second step. A range of molar ratios of unconverted vinylidene olefin to vinyl olefin can be selected but usually at least a molar equivalent amount of vinyl olefin to unconverted vinylidene olefin is used in order to consume the unreacted vinylidene olefins. The product oils have viscosities of from about 1 to 20 cSt at 100° C. Preferably mol ratios of from about 1:20 to 1:1 and most typically about 1:5 of vinyl olefin to total vinylidene olefin are used. The alpha olefin is added at a time when at least about 50 percent by weight of the vinylidene has reacted. The addition is preferably started when the vinylidene dimerization has slowed or stopped which usually occurs when about 75 to 95 weight percent of vinylidene has reacted. Based on the amount of oligomerized olefins, the products will preferably contain at least about 50 weight percent dimer of the vinylidene olefin, up to about 10 weight percent higher oligomer and from about 5 to 40 weight percent of co-dimer of vinylidene olefin and vinyl olefin. More preferably, the product contains about 60 to 90 weight percent vinylidene dimer and about 10 to 40 weight percent co-dimer. A typical composition is about 80 weight percent vinylidene dimer, about 15 weight percent co-dimer and about 5 weight percent of other materials.

The process can be carried out at atmospheric pressure. Moderately elevated pressures e.g. to 10 psi can be used but are not necessary because there is no need to maintain any $BF_3$ pressure in the reactor in order to get good conversions as in the case of vinyl oligomerization.

Reaction times and temperatures are chosen to efficiently obtain good conversions to the desired product. Generally, temperatures of from about −25° to 50° C. are used with total reaction times of from about ½ to 5 hours.

The process is further illustrated by, but is not intended to be limited to, the following example.

Preparation of Vinylidene Olefin

The 1-octene is dimerized to $C_{16}$ vinylidene in the presence of an aluminum alkyl, such as TNOA. The reaction mass contains 1–10 weight percent catalyst, and takes 2–20 days to convert 25–95 weight percent of the 1-octene. The reaction is carried out at temperatures between 100°–150° C. and is under minimal pressure (0 to 20 psig). The catalyst may be either neutralized with a strong base, and then phase cut from the organic material, or it may be distilled and recycled by displacing the octyl with an ethylene group in a stripping column. The unreacted octene is flashed from the $C_{16}$ vinylidene product.

EXAMPLE 1

A low viscosity oil of about 3.5 cSt at 100° C. product is made from hexene and $C_{16}$ vinylidene in the presence of $BF_3$:MeOH catalyst complex by initially reacting 150.3 grams of a feedstock containing 96.4 weight percent $C_{16}$ vinylidene olefin with the balance being mostly $C_{16}$ paraffins. The feedstock is fed to a reactor and 0.1 g MeOH is added with stirring at 1000 rpm. The pot temperature is about 12° C. $BF_3$ is then bubbled through the agitated mixture until an "observable" condition is satisfied (i.e., a 2° C. heat kick in the reaction mass). About 1.9 grams of $BF_3$ is used. After 15 minutes, 48.0 grams, containing 97.0 weight percent $C_6$ alpha-olefin, are added and the reaction is continued for a total of 180 minutes. The $BF_3$:MeOH is washed out of the reaction mixture with water. Two water washes are recommended and the weight of water in each wash is 10–50 percent of the weight of the reaction mixture. The reaction mixture and water are stirred for 10–30 minutes to allow the water to extract the $BF_3$:MeOH from the organic phase. The unreacted $C_6$ and $C_{16}$ can be distilled away from the heavier material. The "lights" may be recycled and the "heavy" material may be used as a 3.5 cSt product. The flash temperature depends on the strength of the vacuum. The total conversion of vinylidene is about 87 weight percent. The heavy material can be fractionated to recover or $C_{22}$ fraction to make a useful 2.5 cSt fluid. Using 1-tetradecene in place of the 1-hexane would be expected to produce a 4.0 cSt at 100° C. product.

The reaction parameters and reaction mixture compositions at different times are shown in Table 1 below:

TABLE 1

| Time elapsed (min.)[1] | 0 | 5 | 17 | 30 | 180 |
|---|---|---|---|---|---|
| Temp. (°C.) | 12.1 | 19.8 | 15.1 | 12.4 | 12.2 |
| $C_6$ (g) | 0.0 | 0.0 | 46.4 | 44.9 | 42.7 |

TABLE 1-continued

| Time elapsed (min.)[1] | 0 | 5 | 17 | 30 | 180 |
|---|---|---|---|---|---|
| $C_{16}$ (g) | 150.3 | 37.9 | 23.3 | 20.1 | 19.5 |
| Other lights (g) | — | 1.3 | 3.0 | 3.1 | 3.7 |
| $C_{22}$ (g) | 0.0 | 0.0 | 8.1 | 12.6 | 15.2 |
| $C_{32}$ (g) | 0.0 | 101.3 | 107.8 | 108.0 | 107.6 |
| Other hvys. (g) | — | 6.4 | 8.9 | 9.0 | 9.0 |
| Analyses wt. % | | | | | |
| $C_6$ | 0.0 | 0.0 | 23.4 | 22.6 | 21.5 |
| $C_{16}$ | 96.4 | 25.2 | 11.8 | 10.1 | 9.8 |
| Other lights | 1.0 | 0.9 | 1.5 | 1.6 | 1.9 |
| $C_{22}$ | 0.0 | 0.0 | 4.1 | 6.4 | 7.7 |
| $C_{32}$ | 0.0 | 67.4 | 54.3 | 54.5 | 54.3 |
| Other hvys. | 1.5 | 4.3 | 4.5 | 4.5 | 4.5 |

[1]Hexene was added at 15 minutes

When the process is carried out without the addition of alpha-olefin, then the maximum conversion of vinylidene is about 80 percent. Consumption of the unconverted vinylidene olefins according to the process of the invention allows most of the feed to be converted to a useful synthetic lubricating oil.

What is claimed is:

1. A process for making a synthetic oil, said process comprising the steps of (a) reacting a vinylidene olefin, which is a dimer of a vinyl olefin monomer containing about 4 to 30 carbon atoms, in the presence of a catalyst to form an intermediate mixture which contains at least about 50 weight percent dimer of said vinylidene olefin, and (b) adding a vinyl olefin, which contains about 4 to 30 carbon atoms, to said intermediate mixture and reacting said intermediate mixture and said vinyl olefin in the presence of a catalyst so as to form a product mixture which contains said dimer of said vinylidene olefin and a co-dimer of said added vinyl olefin with said vinylidene olefin.

2. The process of claim 1 wherein said vinylidene olefin is a dimer of a vinyl olefin monomer containing about 6 to 20 carbon atoms and said vinyl olefin contains about 6 to 24 carbon atoms.

3. The process of claim 1 wherein from about 50 to 95 weight percent of vinylidene olefin in the feed is converted to dimer prior to adding the vinyl olefin.

4. The process of claim 1 wherein the molar amount of said vinyl olefin is at least equivalent to the amount of unconverted vinylidene olefin.

5. The process of claim 1 wherein the molar ratio of added vinyl olefin to total vinylidene olefin in the feed is from about 1:20 to 1:1.

6. The process of claim 1 wherein from about 75 to 95 weight percent of vinylidene olefin in the feed is converted to dimer, such that the reaction of vinylidene olefin to form vinylidene dimer has slowed or stopped, prior to adding the vinyl olefin.

* * * * *